US006826851B2

(12) United States Patent
Nelson, Jr.

(10) Patent No.: US 6,826,851 B2
(45) Date of Patent: Dec. 7, 2004

(54) ANGLED HEEL/SHOES/LOW-FRICTION COALESCENT DANCE SHOES

(76) Inventor: G. Paul Nelson, Jr., 4828 Bissonet, Metairie, LA (US) 70003

( * ) Notice: Subject to any disclaimer, the term of this patent is extended or adjusted under 35 U.S.C. 154(b) by 0 days.

(21) Appl. No.: 10/692,238

(22) Filed: Oct. 23, 2003

(65) Prior Publication Data

US 2004/0148797 A1 Aug. 5, 2004

Related U.S. Application Data

(60) Provisional application No. 60/420,829, filed on Oct. 24, 2002, provisional application No. 60/441,084, filed on Jan. 17, 2003, and provisional application No. 60/460,049, filed on Apr. 3, 2003.

(51) Int. Cl.[7] ..... A43B 5/12; A43C 5/00

(52) U.S. Cl. ..... 36/50.1; 36/8.3; 36/34 R; 36/115; 24/712; 24/713.4; 24/713.6

(58) Field of Search ..... 36/8.3, 50.1, 34 R, 36/39, 115, 116, 103; 24/712, 713.6, 713.4

(56) References Cited

U.S. PATENT DOCUMENTS

| | | | | | |
|---|---|---|---|---|---|
| 124,512 | A | * | 3/1872 | Rand | 36/50.1 |
| 157,972 | A | * | 12/1874 | Pruett | 24/712 |
| 189,027 | A | * | 4/1877 | Evans | 24/713.4 |
| 752,172 | A | * | 2/1904 | Manss | 36/50.1 |
| 1,466,078 | A | * | 8/1923 | Washburn | 24/714.9 |
| 1,984,989 | A | | 12/1934 | Reed | |
| 2,109,712 | A | * | 3/1938 | Emil | 36/8.3 |
| 2,235,256 | A | | 3/1941 | Elliott | |
| 2,572,671 | A | | 10/1951 | Shaw | |
| 2,579,677 | A | * | 12/1951 | Kurkjian et al. | 36/8.3 |
| 2,959,874 | A | | 11/1960 | Schlesinger | |
| 3,633,573 | A | | 1/1972 | Lipson et al. | |
| 3,804,099 | A | * | 4/1974 | Hall | 36/142 |
| 4,065,861 | A | * | 1/1978 | Pelfrey | 36/133 |
| 4,224,749 | A | | 9/1980 | Diaz-Cano | |
| 4,553,342 | A | * | 11/1985 | Derderian et al. | 36/97 |
| 4,578,883 | A | | 4/1986 | Dassler | |
| 6,131,315 | A | | 10/2000 | Frye et al. | |
| 6,158,150 | A | | 12/2000 | Morris et al. | |
| 2003/0056394 | A1 | * | 3/2003 | Yu | 36/8.3 |

* cited by examiner

*Primary Examiner*—M. D. Patterson
(74) *Attorney, Agent, or Firm*—Garvey, Smith, Nehrbass & Doody, L.L.C.; Seth M. Nehrbass; Charles C. Garvey, Jr.

(57) ABSTRACT

A heel for a shoe includes a first relatively flat surface for contacting the ground when one is walking while wearing a shoe having the heel and a second relatively flat surface for contacting the ground when one is dancing and wearing a shoe having the heel. A pair of shoes can have one or two such heels. Preferably, there is a lower-friction portion on the second relatively flat surface. The second relatively flat surface allows one to relatively easily spin while dancing, as compared to dancing with shoes having normal heels.

18 Claims, 8 Drawing Sheets

ANGLED HEEL/SHOES/LOW-FRICTION COALESCENT DANCE SHOES

CROSS-REFERENCE TO RELATED APPLICATIONS

Priority of my U.S. Provisional Patent Application Ser. No. 60/420,829, filed 24 Oct. 2002, incorporated herein by reference, is hereby claimed.

Priority of my U.S. Provisional Patent Application Ser. No. 60/441,084, filed 17 Jan. 2003, incorporated herein by reference, is hereby claimed.

Priority of my U.S. Provisional Patent Application Ser. No. 60/460,049, filed 3 Apr. 2003, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND

1. Field of the Invention

The present invention relates to footwear utilized in dance. More particularly, the present invention relates to a specially configured dance shoe arrangement that enables couples to execute lift spin dance maneuvers more easily.

2. General Background of the Invention

Athletic pursuits have long been a popular and pleasurable pastime, favored by young and old alike as an integral part of a healthy lifestyle. For the great majority of athletic activities, the single most important piece of equipment is comprised of the footwear.

Athletic footwear is currently available in a wide assortment of styles, each specifically adapted for a particular use and ranging from lightweight, high traction running shoes to rigid, protective ski boots. More practical footwear is also available in many choices, from comfortable shoes for walking over extended periods of time to heavily insulated and reinforced work boots. Some articles of footwear are designed to facilitate a variety of activities such as running, walking, jumping and skateboarding. Other articles of footwear are designed specifically for a certain activity, such as dance shoes.

Dance shoes are designed to allow the wearer to execute spinning, sliding or gliding maneuvers on or across the dance floor. The soles and heels of dance shoes are made of materials providing low coefficients of friction.

Various inventors have developed various devices to enable one to engage in activity that enables the wearer to slide or spin. One such device is built from a low friction material and attached to the sole of the shoe in the arch region, thereby allowing the user to slide across a smooth flat surface such as a dance floor. The device may extend below the heel of the shoe and leaves the forefoot area exposed so that the user may engage the floor with the sole to be able to push off into a sliding maneuver. A device of this type is disclosed in U.S. Pat. No. 2,572,671.

Another shoe design that has been patented incorporates a low friction region protruding centrally from the sole with high friction areas surrounding this protuberance. The user can thus engage the supporting surface by tilting the foot to lower the high friction areas of the sole and can slide by pushing off and balance on the protruding area. U.S. Pat. No. 1,984,989 discloses a device of this type.

These prior devices are designed for use on flat, smooth surfaces by a single individual (the wearer). No known prior device lends itself to the execution of two dancers spinning as a single unit (hereinafter, referred to as a coalescent-spinning or "lift spin" dancing). Thus, although well adapted for their intended use as dance footwear, these devices are of limited usefulness and are not the ideal solution for persons desiring to engage in coalescent-spinning activities.

Another shoe design that has been patented incorporates low friction surfaces for sliding across a protruding feature on a supporting surface and walking surfaces for other athletic pursuits, and a method of making same. These shoes have longitudinal grind plates built into the bottom and sides of the shoe to allow the wearer to duplicate maneuvers done with skateboards called grinding. U.S. Pat. No. 6,158,150 discloses an item of this type. These shoes are not intended for dancing, spinning or coalescent-spinning activities.

All of the U.S. Patents mentioned herein are incorporated herein by reference.

BRIEF SUMMARY

The apparatus of the present invention facilitates performing the acrobatic maneuvers called coalescent-spinning or lift spin dancing by enabling a person wearing the shoes to engage an angled or inclined surface (or protruding member) on a supporting surface and support the entire weight of their dance partner while spinning. A unit of low friction surface formed on the shoes can be provided in selected configurations. The low friction spinning surfaces of the present invention can be formed integral to the shoes or can be attached thereto as removable spinning elements, and are equally adaptable to athletic, work, or recreational footwear of all types and styles.

In one embodiment the spinning surfaces of the present invention do not interfere with the traditional functions of footwear and do not require the user to adjust her normal walking, running or dance gait when wearing shoes equipped with such spinning surfaces. Another embodiment includes the incorporation of a liner (e.g., Sorbothane®) or other bruise-protection material within the shoe to protect the wearer's feet from forces exerted by their partner's weight. In another embodiment the apparatus of the present invention adapts specialized equipment to traditional footwear and thereby enlarges the usefulness of such footwear and the enjoyment level of persons wearing it.

The present invention can also be implemented in a wide range of aesthetic and practical choices for design and manufacturing, and can be adapted to appeal to diverse markets and consumers. The coalescent-spinning or lift spin dance apparatus of the present invention can be characterized by a shoe having a heel with a section angled upwardly (away from the floor) at the rear of the heel. This angled section of the heel can be referred to as the coalescent surface. The coalescent surface can be flat and sloped for example between 30 and 60 degrees, more preferably between about 35 and 45 degrees, and even more preferably between about 40 and 45 degrees, measured from the bottom surface of the heel. The coalescent surface can be covered by or comprised of the same low coefficient of friction materials as that of the rest of the heel. A shoe configured in this manner can be called a coalescent dance shoe. The heel by itself is called a coalescent heel. Any make or style of shoe can be made into a coalescent dance Shoe by replacing or installing a coalescent heel as described herein to the bottom of the shoe. The coalescent dance shoe operates in the same manner for either the left or right foot.

A pair of coalescent dance shoes offers a dance couple a wide range of new spinning and acrobatic maneuvers. When a dancer wants to use the coalescent-spinning feature of the coalescent dance shoes, they lift the front of their foot until the coalescent surface is in contact with the dance floor. The partner then leaps, steps or leans on top of the dancer's foot with both spinning as a single unit. This apparatus provides the capability to perform coalescent-spinning maneuvers without hampering the user's ability to perform other traditional dancing activities or individual maneuvers.

Another embodiment of the aforementioned apparatus is one containing a projection within the coalescent surface. A shoe with this design is called a low-friction coalescent dance shoe. A heel by itself and of this design can be called a low-friction coalescent heel. The spinning point or projection can be comprised of low coefficient of friction material that is slightly raised above the surface of the heel's inclined surface or coalescent surface. The raised point will reduce the effective surface area in contact with the floor and increase spin speeds. The spinning point can have many different shapes and designs providing a wide range of handling characteristics.

The present invention includes a dance shoe, that is, a shoe adapted in design and manufacture for activities involving all forms and types of dance.

Because the design of some embodiments places all coalescent-spinning elements outside of the shoe interior, additional cushioning material may be placed over the insole to increase the user's comfort and safety during coalescent-spinning maneuvers.

In another embodiment the apparatus can be mounted onto any type or model of dance shoe making the shoe a coalescent dance shoe. The coalescent heel may be formed with different downward facing configurations, and thus a coalescent heel adapted for dance floors with higher coefficients of friction may feature a high degree of angle and narrower coalescent surface, whereas a coalescent heel for faster dance floors may feature a lower degree of angle and wider coalescent surface. In addition, coalescent heel may be manufactured in different colors that appeal to the fashion sense of the user, and individual coalescent surface may be formed with strata of different colors to indicate the degree of angle or even the level of wear upon the coalescent surface.

The present invention is not limited to providing coalescent-spinning elements that are permanently attached to articles of footwear. Any method may be used to provide an article of footwear with low friction coalescent-spinning surfaces, and may include forming the spinning surfaces integral to the sole and/or heel during the extrusion molding process, or alternatively may consist of sintering low friction material into certain regions of the sole and/or heel. The use of such permanent, non-removable spinning surfaces is highly dependent upon the ready availability of materials of sufficient durability to withstand repeated coalescent-spinning activities on dance surfaces for the expected lifetime of the article of footwear. In another embodiment the present invention can also include removable coalescent-spinning elements.

The present invention is not limited to providing coalescent-spinning surfaces on the rear of the heel of an article of footwear. Low friction coalescent-spinning surfaces may also be formed on the sides of the heel or the corners of the heel.

In operation, when a user desires to participate in dancing activities, he or she may put on the shoe and can dance in the normal fashion. The coalescent surface can be sufficiently recessed upwardly from the bottom surface of the heel to reduce contact with the supporting surface. Thus, the present invention allows the sole of the shoe to function along the supporting surface in the manner typical to most footwear and does not force the user to change his or her normal dance gait.

Because the normal dance gait of an upright human involves first contacting the heel of the shoe and then rolling forwardly onto the ball of the foot and then lifting the heel up, most of the flex in the sole is localized in the forward and metatarsal area of the foot with more rigidity being in the arch. During coalescent-spinning activities, the bulk of the user's foot control is shifted from the central arch section to the back heel section. To facilitate this control, additional rigidity in the foot frame may be required in the aft-foot section for certain types of dance shoe.

The present invention is comprised of a dance shoe, that is, a shoe adapted in design and manufacture for activities involving all forms and types of dance. The low-friction coalescent dance shoe is similar in all respects with the coalescent dance shoe except it has an additional feature of a spinning point added to the coalescent surface. The spinning point will have many different shapes and designs providing a wide range of handling characteristics. In addition, because the spinning points are removable and relatively compact the user may conveniently carry one or more of them in a bag or even in a coat or pant pocket and interchange them as the coalescent-spinning conditions encountered may warrant, thereby increasing the range of coalescent-spinning options and opportunities.

Because the design of the present embodiment places all coalescent-spinning elements outside of the shoe interior, additional cushioning material may be placed over the insole to increase the user's comfort and safety during coalescent-spinning maneuvers.

Although the embodiments described herein have been described in terms of spinning surfaces or elements formed or adapted to shoes, it will be appreciated by those skilled in the art that the apparatus of the present invention is equally adaptable to any and all types of footwear. Coalescent-spinning surfaces can thus be formed in elements adapted to, sandals, boots, shoes, slippers and any other device or article of wear that is meant to be attached to the human foot. This apparatus can be mounted onto any type or model of dance shoe making the shoe a coalescent dance shoe.

The low-friction coalescent heel may be formed with different downward facing configurations. Thus a low-friction coalescent heel adapted for dance floors with higher coefficients of friction may feature a high degree of angle and narrower coalescent surface and spinning point, whereas a low-friction coalescent heel for faster dance floors may feature a lower degree of angle and wider coalescent surface and spinning point. In addition, a low-friction coalescent heel may be manufactured in different colors that appeal to the fashion sense of the user, and individual coalescent Surface and spin points may be formed with strata of different colors to indicate the degree of angle or even the level of wear upon the coalescent Surface.

The low-friction coalescent heel may be attached to the sole of any type shoe by any means of sufficient mechanical strength to withstand the shear forces generated during coalescent-spinning maneuvers, such as chemical bonding. Alternatively, the coalescent surface may be configured with ribs or other protuberances that reduce total spinning area and thus total frictional resistance. And, the spin point may be formed from any low friction material exhibiting sufficient stiffness and mechanical strength to be directly attached to the low-friction coalescent heel.

In operation, when a user desires to participate in dancing activities, he or she may put on the shoe and can dance in the normal fashion. The coalescent surface and spinning point are sufficiently recessed upwardly from the bottom surface of the heel to reduce contact with the supporting surface. Thus, the present invention allows the sole of the shoe to function along the supporting surface in the manner typical to most footwear and does not force the user to change his or her normal dance gait.

Because the normal dance gait of an upright human involves first contacting the heel of the shoe and then rolling forwardly onto the ball of the foot and then lifting the heel up, most of the flex in the sole is localized in the forward and metatarsal area of the foot with more rigidity being in the arch. During coalescent-spinning activities, the bulk of the user's foot control is shifted from the central arch section to the back heel section. To facilitate this control, additional rigidity in the foot frame may be required in the aft-foot section for certain types of dance shoe.

The spinning point can be constructed of a material selected to afford the desired low coefficient of friction spinning characteristic. In addition, the material selected must offer substantial rigidity when cut, injection molded or shaped in the dimensions specified to allow the user to maintain control while engaged in coalescent-spinning maneuvers. A material known to exhibit these desirable characteristics is Supertuf 801 Nylon available from Dupont. Other materials that may be found to be acceptable include other forms of nylon, such as Nylon 6, plastics such as PTEX, ceramics, metals, polyethylene and composites.

The spinning point is selected and installed on or inserted within the cavity of the low-friction coalescent heel, where it is secured by threading a screw through the spinning point and into the core heel material or an anchor made of brass, stainless steel or other materials. The screw is conveniently provided with engagement slots or sockets formed in the top surface of the heads for engagement by a screwdriver or other tool for quick and easy turning. Alternatively, or in addition, high strength adhesives such as epoxy may be employed to fasten the spinning point to the coalescent surface in a permanent configuration that sacrifices spinning point interchangeability for a stronger, more secure bond. The spinning point can be manufactured in a variety of styles to fit a variety of uses, and the rapid replacement feature detailed above enables quick swapping of spinning points to accommodate varying conditions and surfaces. In this manner a user may choose, for example, to install one type of spinning point on the right shoe and a different type of spinning point on the left shoe.

As described earlier, spinning points may be formed in many different materials, colors, sizes, and bottom configurations, and the design of the present embodiment allows the user to quickly and easily change spinning points at any time he or she may choose to do so. As mentioned above, the fasteners are preferably self-locking screws, thereby reducing the likelihood that the vibrations and shocks experienced by the shoes during use will loosen and eventually eject the screws.

The screw can be, for example, a Nylock self-locking screw of 4 or 5 mm shaft diameter, approximately 12 mm head diameter, and varying length as dictated by the overall height of the spinning point. Screws of various lengths and or materials such as elastomers may be used to accommodate different spinning point materials and thickness, giving the user the ability to adjust performance characteristics of the spinning point to match the requirements of different dancing surfaces.

The removable spinning points require some rudimentary tools, whether a screwdriver, a knife, or a coin, to disengage the respective fasteners and remove the spinning point. It is foreseeable that the need may arise for a spinning point design employing a fastening system that requires absolutely no tools for removal and replacement, and is even quicker and easier to operate.

When a couple executes a lift spin or coalescent spin, the dancer having contact with the dance floor (first dancer) is considered the spinner and the dancer with no contact with the dance floor (second dancer) is considered the rider. The rider can use any part of their body on that of the spinner's body to remove contact with the dance floor.

A highly athletic activity involving, for instance, an aggressive foot-on-foot coalescent-spinning maneuver wherein the rider might step with some force onto the top surface of the spinner's foot, the landing force of the rider may exceed the weight of the athlete, e.g., 100 pound (45 kilogram) rider lands with, e.g., 110 pounds (490 newtons) of force. Sufficient structural integrity to withstand such impacts can be built into the interior and exterior portions of the shoe (e.g., Sorbothane®) providing for cushioning of the top, sides and heel portions of the spinner's foot thereby minimize bruising and injury.

As the spinner maneuvers in a coalescent-spinning action, he or she can maneuver the foot about to maintain control or execute further acrobatic maneuvers. When the spinner elects to undertake a maneuver requiring a crouch position, he or she may bend the knees into a deep bend without losing contact with the coalescent surface.

This apparatus can be mounted onto any type or model of dance shoe making the shoe a coalescent dance shoe. The rear of the heel comprises the coalescent surface and is attached and held firmly to the main heel body through the use of a grooved channel and two magnets. The magnetic force is exerted on two metal slots recessed and adhesively bonded in to the main heel body. The detachable portion of the heel allows the user to quickly change the function of a shoe depending on which style of attachment is used. In this way, a coalescent dance shoe can be converted into a low-friction coalescent dance shoe or can even be made to look like a generic model shoe.

A coalescent surface attachment can be inserted into a groove at the rear of the heel and once attached and held firmly to the shoe through use of rivets, screws, adhesive and/or any other means of fastening.

A ball bearing mounted projection can be recessed into the main heel body, but sufficiently exposed above the coalescent surface to allow contact with the surface of the dance floor when the user enters into a coalescent spin with their partner. The ball bearings can be made of a low-friction polymer such as Teflon, but can be made of just about any material depending on its usefulness, availability, and non-deleterious effects on dance surfaces. The number of ball bearings used can vary from one to many.

A spinning disk can be recessed into the main heel body, but the surface of the spinning disk is sufficiently exposed above the coalescent surface to allow contact with the surface of the dance floor when the user enters into a coalescent spin with their partner. The surface of the spinning disk will be covered with the same materials used on the coalescent surface, but any other materials can also be used depending on the user's preferences. The internal mechanism of the spinning disk utilizes an axle and roller bearing configuration similar to those used in most bicycle wheels. The size and configuration of the spinning disk used can vary.

A low-friction spinning point is fastened to the main heel body and is surrounded by a compressible medium such as Sorbothane. The thickness of the compressible medium has equal height dimensions as that of the low-friction spinning point. The same material used to cover the bottom of the heel (the portion in normal contact with the dance floor) is also used to cover the compressible medium. However, this covering material does not cover or interfere with the top of the low-friction spinning point. The durometer of the compressible medium will be such that the weight of the wearer alone does not compress the medium enough to expose the surface of the low-friction spinning point to the dance floor, but the addition of their partner's weight (50 pound (222 newton) minimal differential) will be sufficient enough weight to compress the medium enough to expose the surface of the low-friction spinning point to the dance floor.

The sole and heel are independent of each other. When this type sole is mounted to the bottom of a dance shoe, it allows the wear to execute spins on the low-friction spinning point by placing all of their weight onto the ball of the foot, which compresses the medium and exposes the low-friction spinning point. The durometer of the compressible medium will be of sufficient hardness to allow a dancer to perform normal dance activities without exposing the low-friction spinning point, but of sufficient softness to allow maximum compressibility when subjected to the full weight of the dancer. While the dimensions and core materials of the sole are different than the heel, a heel of this type design operates in the exact same way as that of the sole outlined above.

When the wearer of a shoe rocks back to execute a spin with their partner, their combined weight can be used to activate a system where one or more low-friction spinning points are pushed from the bottom of the heel to aid in maintaining balance. The pressure system can be of various designs, but is anticipated to use a non-compressible liquid medium housed in a rubber bladder. The pressure system can also be located in various sections of the shoe depending on the desired performance requirements.

When the wearer of a shoe with this style of heel rocks back to execute a coalescent spin with their partner, the partner's weight activates a system where the front portion of the heel is released from the shoe body and pivots down to make contact with the dance floor automatically latching in that position. Once the partner removes their weight, the latch is released allowing the wearer to rock forward and automatically lock the heel in its normal position. The activation system can be of various designs, but is anticipated to use a battery-powered sensing and operating mechanism housed within the upper portion of the shoe and heel body.

The front bottom of the heel (portion facing the inner arch of the foot) can be angled upwards away from the dance floor with an angle of between about 10 and 80 degrees, but normally expected to be about 45 degrees. Adhered to the face of the angled portion of the heel can be a layer of absorbent material such as Sorbothane. When the rider of a coalescent spinning couple steps onto the spinner's foot, the absorbent material of the rider's heel becomes one of the load bearing points. The absorbent material prevents bruising of the spinner's foot. The durometer of the absorbent material can be varied according to the dancer's requirements, but is expected to normally be of 60 durometer.

Other features and advantages of the present invention will become apparent from the following description, taken in conjunction with the accompanying drawings, which illustrate, by way of example, the features of the invention. While each of the figures that accompany the disclosure depicts an article of footwear being used on the right foot of a user, every embodiment disclosed herein can be equally adaptable to use on the left foot of a user.

BRIEF DESCRIPTION OF THE SEVERAL VIEWS OF THE DRAWINGS

For a further understanding of the nature, objects, and advantages of the present invention, reference should be had to the following detailed description, read in conjunction with the attached drawings, wherein like reference numerals denote like elements.

DETAILED DESCRIPTION

Figure 24:
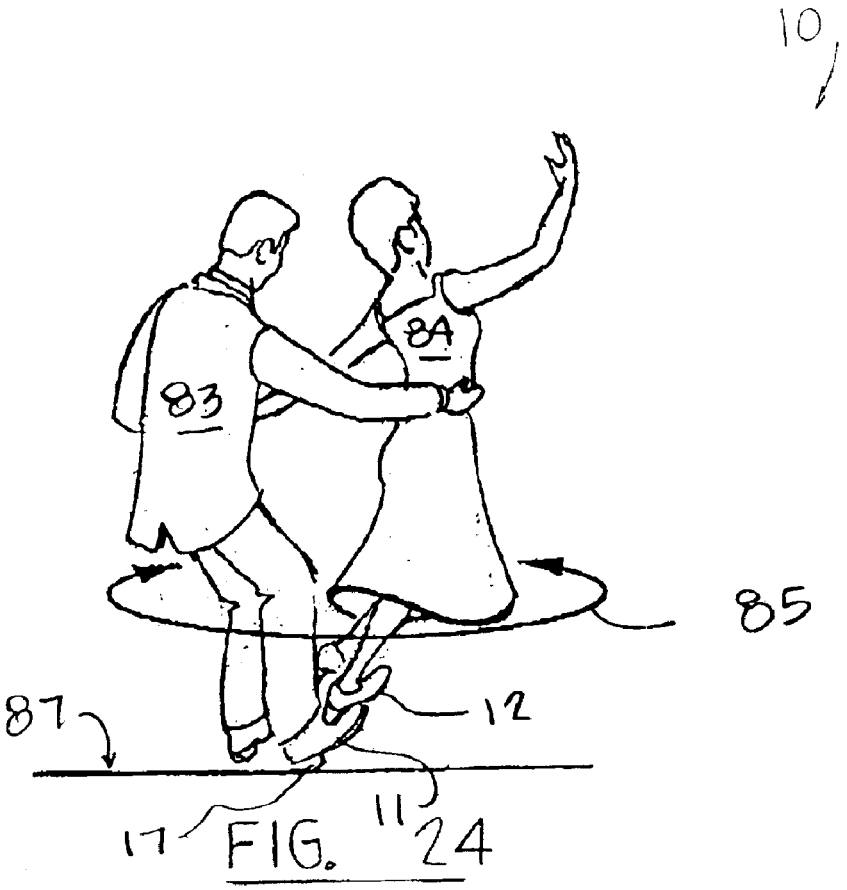
FIG. 24 is a perspective view illustrating a preferred embodiment of a method of the present invention and a preferred embodiment of the apparatus of the present invention during use.
Figure 25:
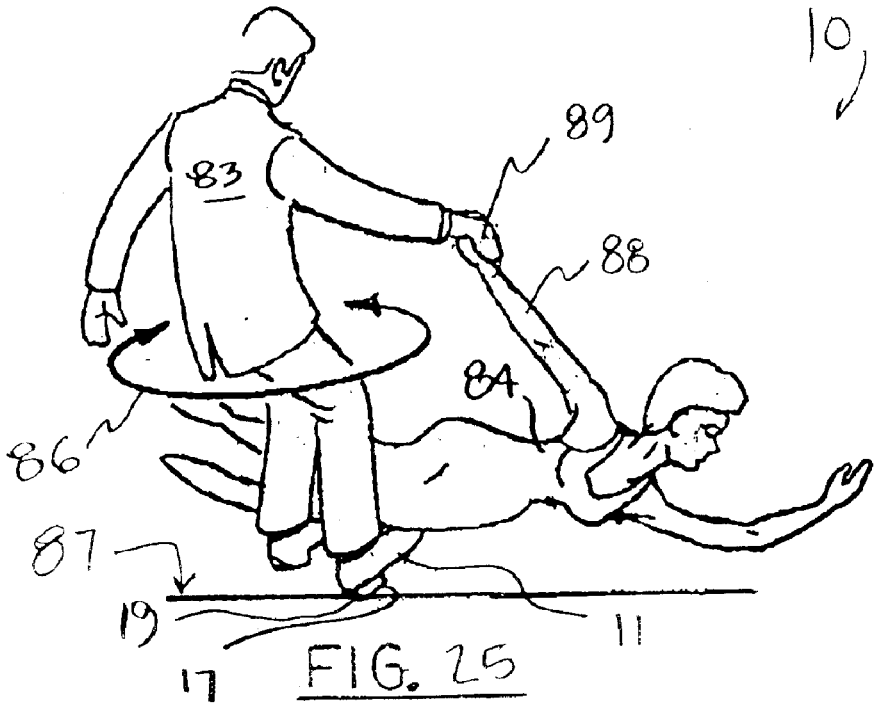
FIG. 25 is a perspective view illustrating a preferred embodiment of a method of the present invention and a preferred embodiment of the apparatus of the present invention during use.

In FIGS. 24 and 25, a lift spin dancing apparatus 10 is shown that includes shoes 11, 12 that are specially configured and are worn respectively by a first dancer 83 and a second dancer 84.

When lift spin dancing, a first dancer 83 supports the full weight of a second dancer 84 and then executes a spin maneuver. In FIG. 24, the second dancer 84 is standing upon the foot of the first dancer 83. The first dancer 83 is wearing a first shoe 11 such as shown and described with respect to the embodiments of FIGS. 1-20. The second dancer 84 is wearing a second shoe 12 and shown and described with respect to FIGS. 21-23.

As will be described more fully hereinafter, the first shoe 11 can have a heel 17 that can have an inclined surface 19 that rests upon a supporting floor 87 and wherein the first dancer 83 simultaneously performs a spin as indicated by arrow 85. In FIG. 25, a different lift spin dancing movement is shown wherein the second dancer 84 extends an arm 88 upwardly so that it is grasped by the hand 89 of first dancer 83.

The second dancer 84 assumes a generally horizontal position so that the body of the first dancer 84 rests upon the foot of the second dancer 83 as shown in FIG. 25. Again, the first dancer 83 has a first shoe 11 with a heel 17 having an inclined surface 19.

In FIG. 25, the inclined surface 19 engages a supporting flat surface such as floor 87 and spins as indicates schematically by the arrow 86 in FIG. 25. Each of the dance moves illustrated in FIGS. 24 and 25 is referred to generally as a lift spin move or coalescent dancing move. The shoes 11, 12 that are used to perform the moves illustrated in FIGS. 24 and 25 can include the first shoe 11 of FIGS. 1, 2 and 3 or the alternate heel constructions for the first shoe 11 that are shown in FIGS. 4-20.

Figure 21:
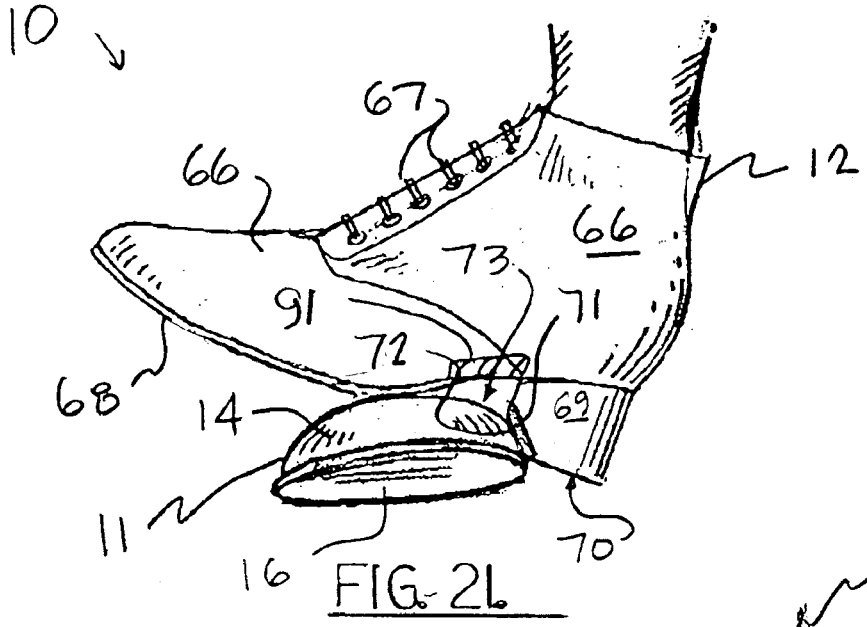
FIG. 21 is a side elevation view of an alternative embodiment illustrating a shoe to be wore by a second dancer when couples dancing.
Figure 23:
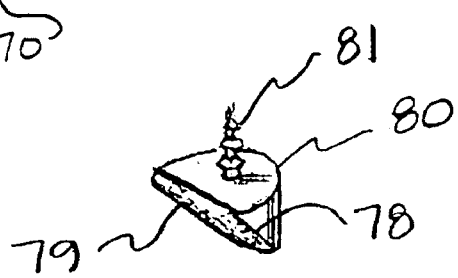
FIG. 23 is a fragmentary view of the alternative heel embodiment of FIG. 22.
Figure 22:
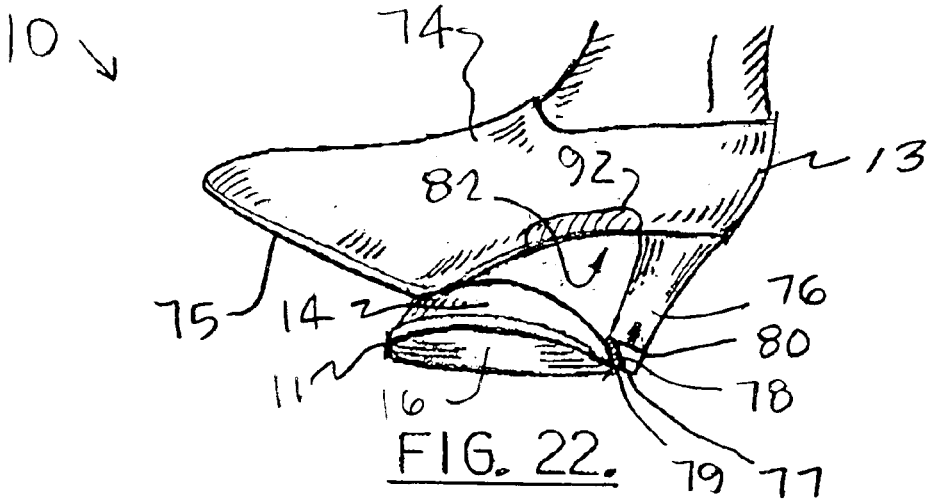
FIG. 22 is a side elevation view of a preferred embodiment illustrating a shoe to be wore by a second dancer when couples dancing.

The second shoe 12 that is worn by the second dancer 84 in FIGS. 24 and 25 can be the second shoes that are shown and described as shoes 12, 13 in FIGS. 21-23.

Figure 1:
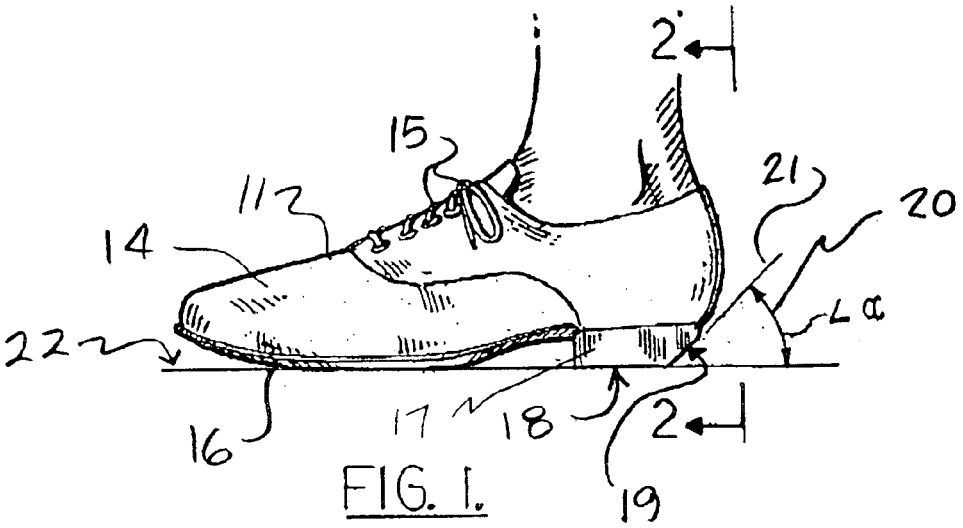
FIG. 1 is a side elevation view of a preferred embodiment of the apparatus of the present invention.

In FIG. 1, first shoe 11 can have an upper 14 and laces 15. Shoe 11 has a sole 16 and a heel 17.

Heel 17 can have a heel bottom surface 18 and an inclined surface 19 that forms an angle 20 between about 10 and 80 degrees and preferably about 40–45 degrees. In FIG. 1, the angle 20 is measured from reference line 21 to floor 22.

Figure 3:
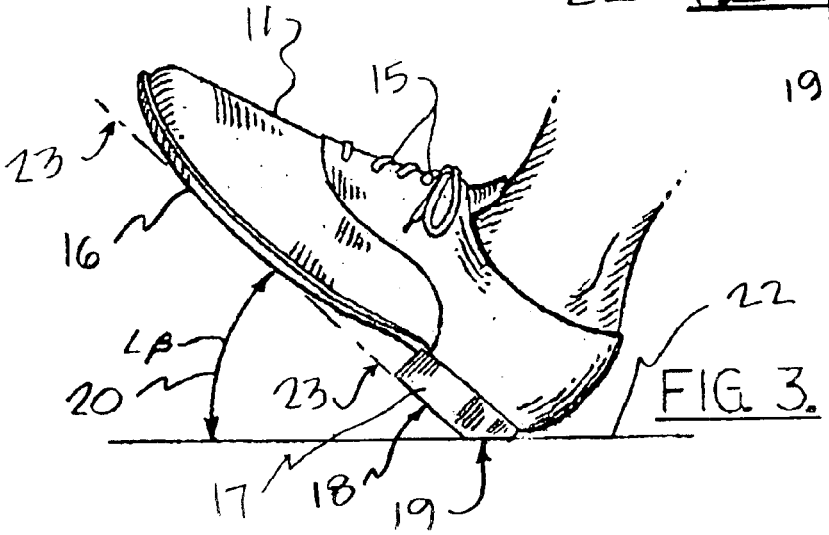
FIG. 3 is a side elevation view of the embodiment of FIG. 1 showing a first dancer's shoe in a position immediately prior to a spin.

In FIG. 3, the first shoe 11 has been rotated to a position that engages floor 22. In FIG. 3, the angle 20 is measured between floor 22 and reference line 23 that basically tracks the heel bottom surface 18 as shown in FIG. 3.

Figure 2:
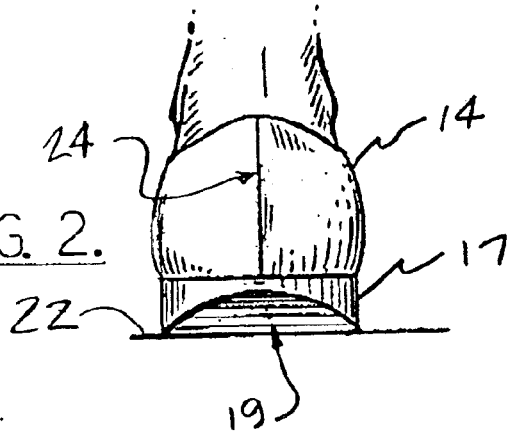
FIG. 2 is a view taken along lines 2—2 of FIG. 1.

In FIG. 2, the rear seam 24 of the shoe 11 is shown with the inclined surface 19 being basically centered upon the rear seam 24.

Figure 4:
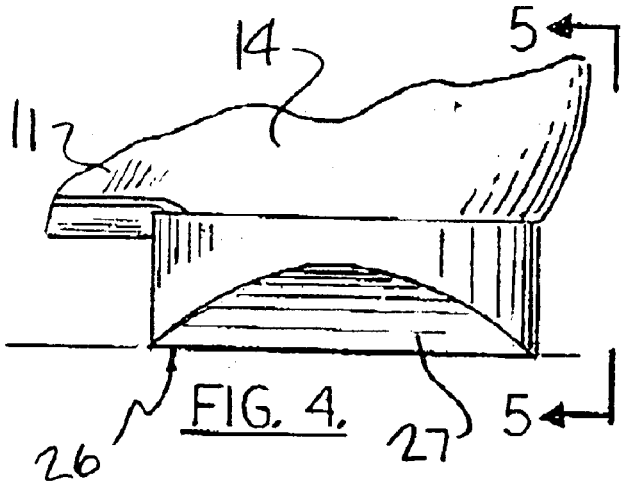
FIG. 4 is a fragmentary side view illustrating an alternate heel construction.
Figure 5:
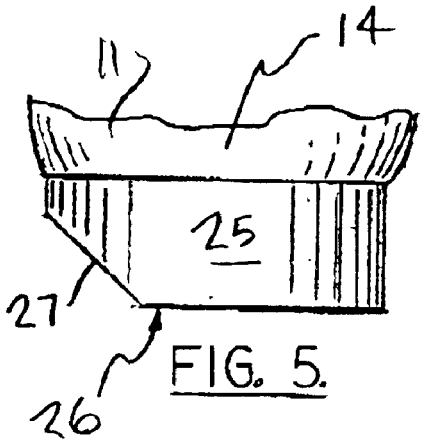
FIG. 5 is a view taken along lines 5—5 of FIG. 4.

In FIGS. 4 and 5, inclined surface 27 can be on the side of the heel 25, forming an obtuse angle with heel bottom surface 26.

Figure 6:
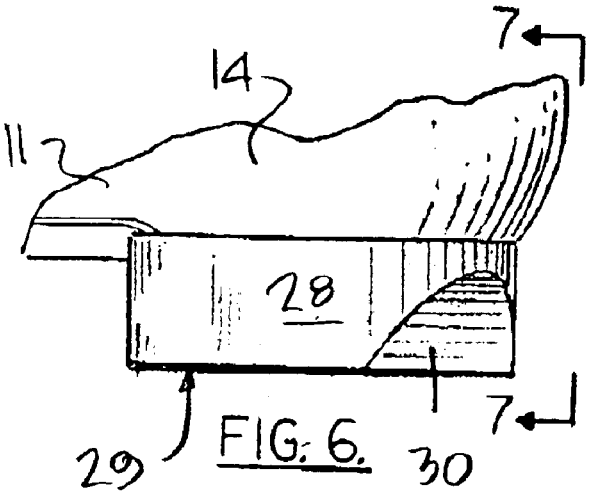
FIG. 6 is a fragmentary side view illustrating an alternate heel construction.
Figure 7:
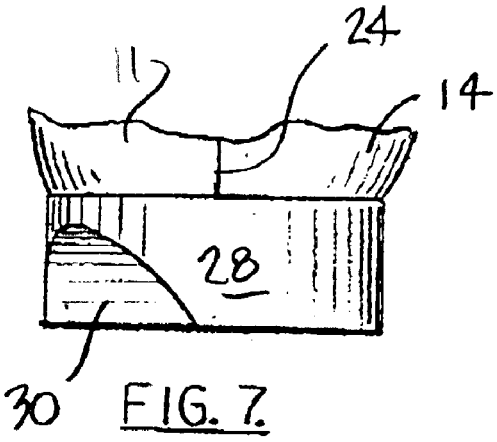
FIG. 7 is a view taken along lines 7—7 of FIG. 6.

In FIGS. 6 and 7, a heel 28 is shown that can be used with shoe 11 that places inclined surface 30 at the rear and comer of heel 28, again forming a obtuse angle between heel bottom surface 29 and inclined surface 30.

Figure 8:
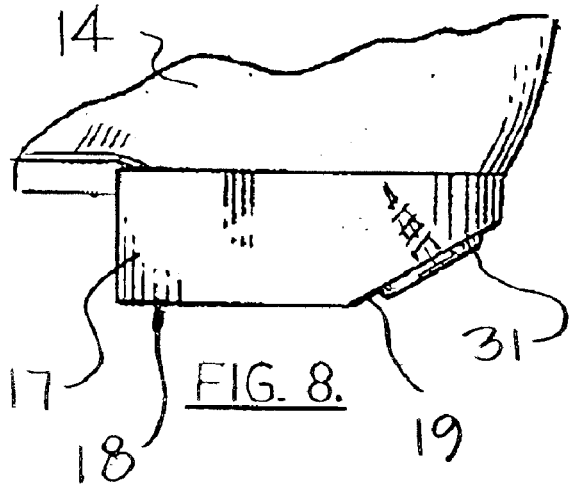
FIG. 8 is a fragmentary elevation side view illustrating an alternate heel construction.
Figure 9:
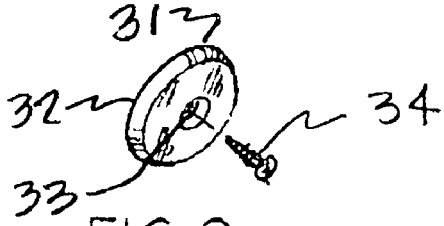
FIG. 9 is a fragmentary view illustrating the heel embodiment of FIG. 8, particularly the projecting member portion thereof.

In FIGS. 8 and 9, a heel 17 is shown having bottom surface 18 and inclined surface 19. In FIGS. 8 and 9, a disk projecting portion 31 is in the form of a donut or circular shaped body 32 having central opening 33 that receives fastener 34 such as a wood screw or the like. The disk shaped projecting portion 31 defines a spin point so that when the dancer 83 places shoe 11 in the position of FIG. 3, just prior to spinning the shaped body 32 engages the underlying floor 22 as opposed to the floor 22 engaging inclined surface 19.

Figure 10:
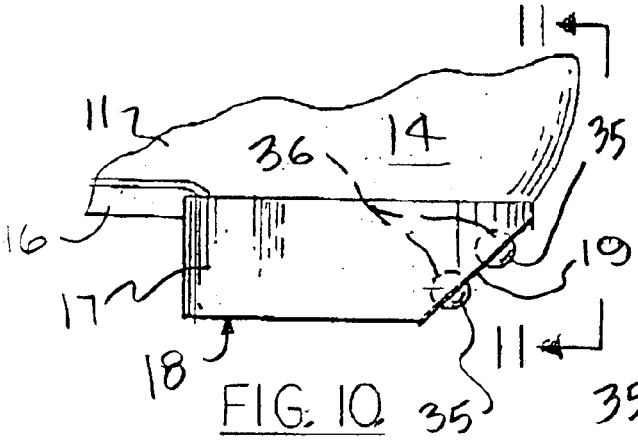
FIG. 10 is a side elevation view illustrating an alternate heel construction.
Figure 11:
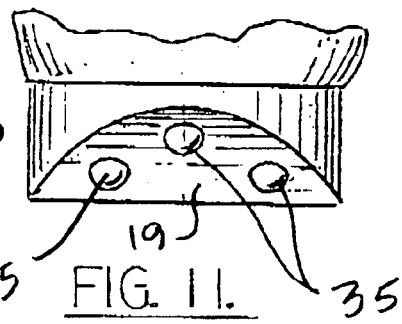
FIG. 11 is a view taken along lines 11—11 of FIG. 10.

In FIGS. 10 and 11, heel 17 has a plurality of hemispherically shaped openings 36, each receptive of a spherical projecting portion 35.

Figure 12:
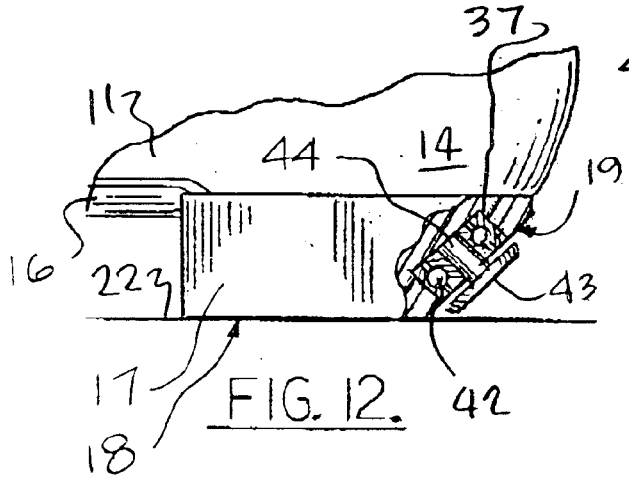
FIG. 12 is a side fragmentary elevation view illustrating an alternate heel construction.
Figure 13:
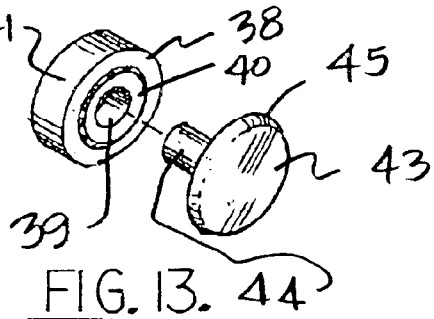
FIG. 13 is a fragmentary view illustrating the projecting disk and bearing portion thereof for the heel of FIG. 12.

In FIGS. 12 and 13, a cylindrically shaped socket 37 receives rotary bearing 38. As shown in FIGS. 12 and 13, the rotary bearing 38 includes an inner ring 40, and outer ring 41, and a plurality of ball bearings 42. The inner ring 40 has a central opening 39 that is sized and shaped to form a tight fit with peg 44 of projecting portion 43. In the embodiment of FIGS. 12 and 13, the projecting portion 43 engages floor 22 when the dancer 83 places shoe 11 of FIG. 3 just before a spin and during spinning. The projecting portion 43 can comprise the combination of disk 45 and shaft 44.

Figure 14:
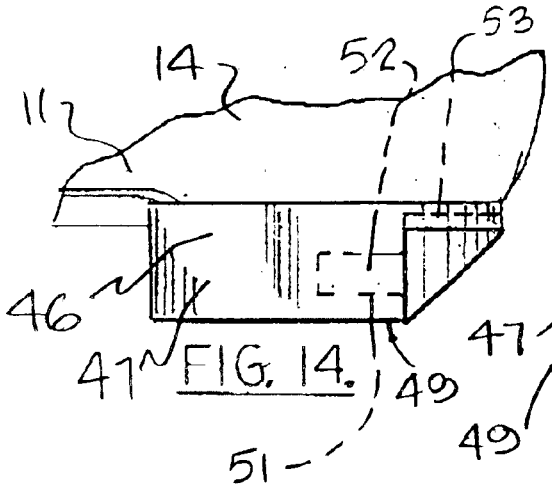
FIG. 14 is a fragmentary side elevation view showing an alternate heel construction.
Figure 15:
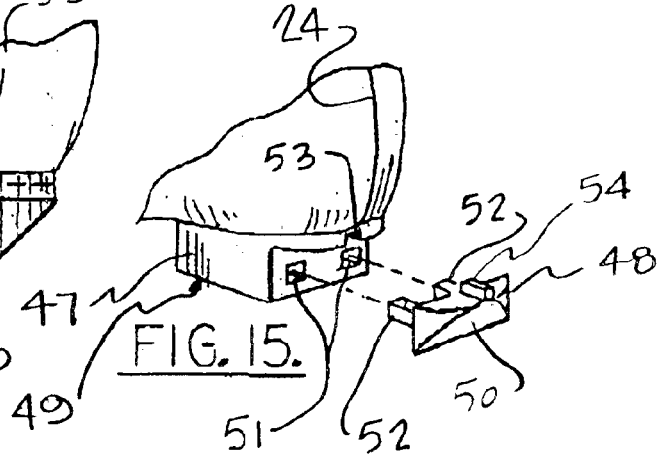
FIG. 15 is a fragmentary perspective exploded view illustrating the heel construction of FIG. 14.

In FIGS. 14 and 15, heel 46 includes a forward heel section 47 and a rear heel section 48. The forward heel section 46 has a bottom surface 49. The rear heel section 48 removably connects to the forward heel section 47 with a plurality of pegs 52. The pegs 52 engage correspondingly sized and shaped sockets 51 on forward heel section 47 as shown in FIGS. 14 and 15. The rear heel section 48 has an inclined surface 50 that forms an obtuse angle with the bottom surface 49 of heel forward section 47. A rail 54 can be provided on rear heel section 48 that fits a correspondingly sized and shaped slot 53 or forward heel section 47.

Figure 16:
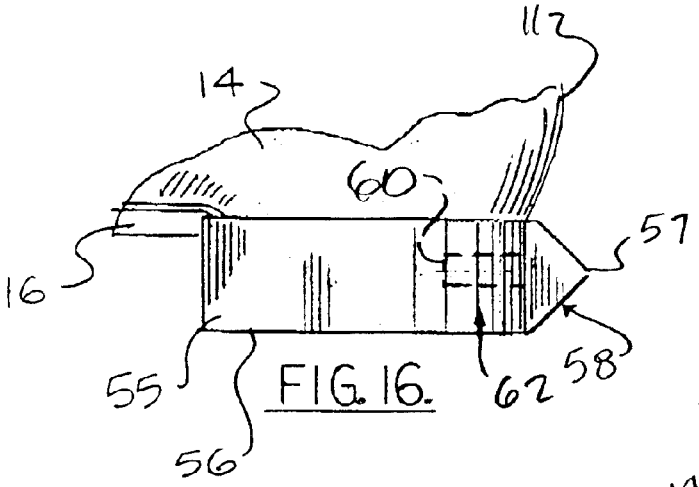
FIG. 16 is a fragmentary side elevation view showing an alternate heel construction.
Figure 17:
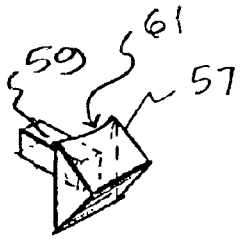
FIG. 17 is a fragmentary perspective view showing the insert part of the heel construction of FIG. 16.

In FIGS. 16 and 17, first shoe 11 can be provided with a heel 55 that has a heel bottom surface 56 and an insert 57 that removably connects to the heel 55 with peg 59. Peg 59 fits a socket 60 on heel 55 as shown in FIG. 16. The insert 57 includes an inclined surface 58 that is a spin surface when the dancer 83 places show 11 in the position of FIG. 3. The insert 57 has a curved surface 61 that is concave in shape and that corresponds to the shape of convex curved surface 62 of heel 55.

Figure 18:
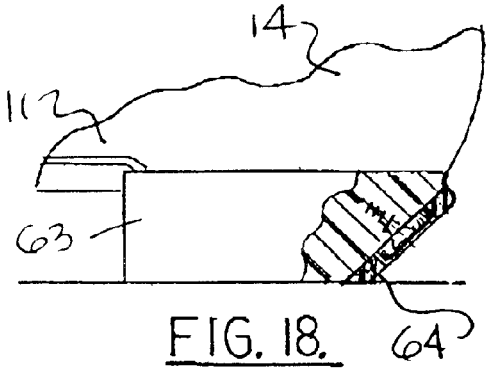
FIG. 18 is a side, elevation, partially cutaway view of an alternate heel construction.
Figure 19:
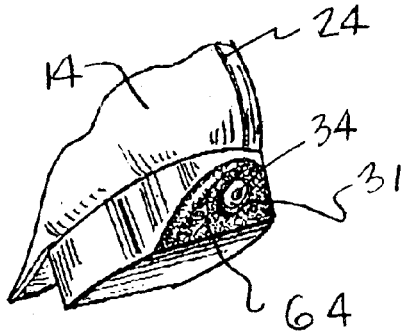
FIG. 19 is a fragmentary perspective view of the alternate heel construction of FIG. 18.

In FIGS. 18 and 19, first shoe 11 has heel 63 with compressible material (for example, Sorbothane®). The compressible material 64 can be placed on the inclined surface 19 and surrounding disk projecting portion 31 or projecting portion of 43 of FIG. 13. The compressible material 64 helps grip the floor to prevent falling yet does not hamper a spin when the shoe 11 is placed in the position of FIG. 3. The compressible material 64 compresses enough so that a spin can be perfected by engaging an underlying floor 22 with either the projecting portion 31 or the projecting portion 43.

Figure 20:
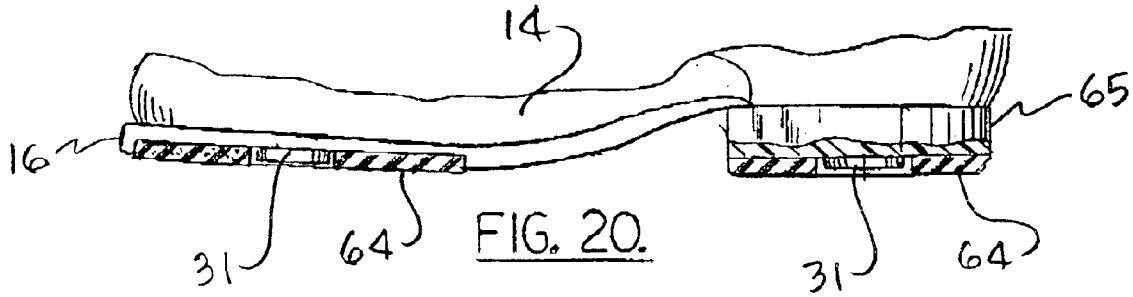
FIG. 20 is a partial side elevation view of alternate heel and sole construction.

In FIG. 20, projecting portions 31 have been placed on heel 65 and on sole 16 as shown in FIG. 20. In FIG. 20, the compressible material 64 can be placed upon either sole 16 or heel 65, preferably surrounding either or both of the projecting portions 31.

In FIGS. 21-23, second shoes 12, 13 are shown. The shoes 12, 13 would typically be used by a second dancer 84 as shown in FIGS. 24 and 25. Second shoe 12 can have an upper 66, laces 67 and a sole 68. Heel 69 can have a heel bottom surface 70 that is generally flat. In front of the heel 69 can be provided an inclined surface 71 that can be fitted with a cushion 72 (for example, Sorbothane® brand cushioning material). A concavity or void space 73 is defined in front of inclined surface 71 and to the rear of a majority of sole 68. As shown in FIG. 21, the void space 73 can be registered upon the upper 14 of first shoe 11 when executing the dance move of FIG. 24.

The second shoes 12 and 13 in FIGS. 21 and 22 can also include an abrasion and shock absorbing device 91 (shoe 12) and 92 (shoe 13) that protects the shins of dancer 83. This shin-protecting device can comprise any suitable shock absorbing material such as Sorbothane® and is preferably located in the lower arch region including the edges and interior portions of the heel and can extend along the edges of the shoe as far forward as the toe region. The shock absorbing material can be affixed to the external portion of the shoe as an addition or be built into the shoe's structure. The shock absorbing material can be covered by a layer of leather or felt, but it is not required to be so covered.

In FIG. 22, a second shoe 13 to be worn by a second dancer 84 can include an upper 74, sole 75, and high heel 76. High heel 76 can provide a bottom surface 77 and inclined surface 78 that can be fitted with a cushion 79 such as Sorbothane (see FIGS. 22-23). The heel 76 can include a removable lower section 80 that is attached with fastener 81. A concavity 82 is defined as an area in front of high heel 76 and to the rear of shoe 13 forefoot 89.

FIG. 22 illustrates the position of the first shoe 11 of dancer 83 in FIG. 24 when the first shoe 11 and dancer 83 are supporting the full weight of the second dancer 84.

Figure 26:
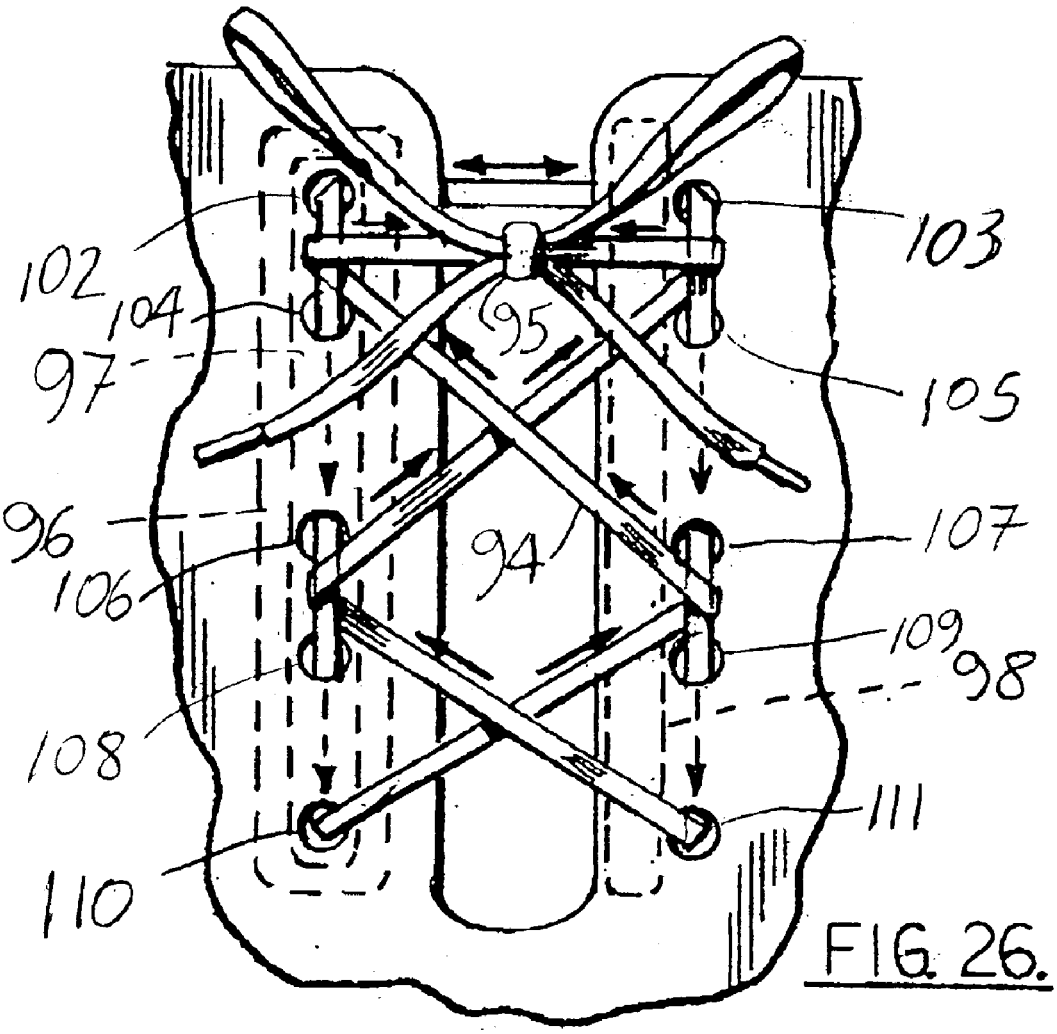
FIG. 26 shows part of a shoe near the shoe lace holes.

Part of a shoe near the shoe lace holes 102–111 is shown in FIG. 26. The shoe lace holes 102–111 are spaced differently from normal shoes (on each side, two groups of two spaced close together, and one at the bottom), and the shoes are laced differently (one starts by putting each end of shoe string 94 through one of the holes 102, 103 at the top, instead of the bottom, then threading the string as indicated by the arrows, then tying with a normal knot 95 up at the top).

Figure 27:
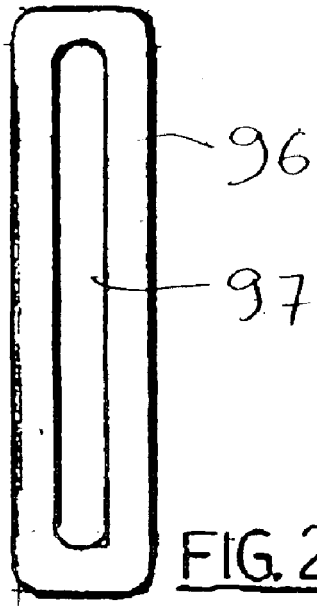
FIG. 27 shows a plastic insert that can reinforce the area of the shoe around the lace holes (it is indicated in dotted lines on the left side of FIG. 26)

FIG. 27 shows a plastic insert 96 (which could be, for example, the thickness of a standard credit card issued in the US) that can reinforce the area of the shoe around the lace holes 102, 104, 106, 108, 110 (it is indicated in dotted lines on the left side of FIG. 26). Insert 96 includes an opening 97 through which shoe lace holes 102, 104, 106, 108, 110 are formed.

Figure 28:
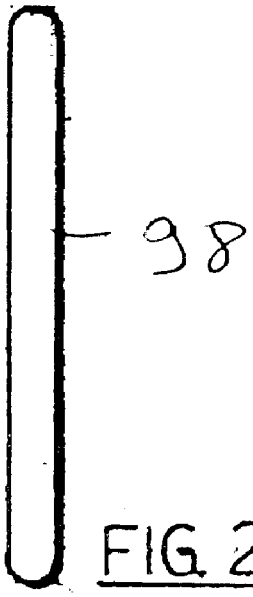
FIG. 28 shows a similar insert, but which only goes on one side of the holes (as shown in dotted lines on the right side of FIG. 26), instead of surrounding the holes as does the insert of FIG. 27.

FIG. 28 shows an insert 98, similar to insert 96, but which only goes on one side of the holes (as shown in dotted lines on the right side of FIG. 26), instead of surrounding the holes as does insert 96.

Inserts 96 and 98 could be about the length of the distance from the top hole 102, 103 to the bottom hole 110, 111. Insert 96 is wider than the shoe lace holes (for example, about twice or three times as wide as the diameter of the shoe lace holes). Insert 98 can be about the width of the diameter of the holes up to about twice as wide as the diameter of the holes. Inserts 96 and 98 are shown in a single shoe in FIG. 26, though normally a shoe containing inserts would either contain two inserts 96 or two inserts 98. Also, one could instead use inserts only adjacent the double holes (e.g.,just along holes 102 and 104, a second insert along holes 103 and 105, then a third insert along holes 106 and 108, and a fourth insert along holes 107 and 109).

The present invention includes an interwoven shoe lacing process for lacing shoes, for use with any shoe with a 2×2×1 lace-hole pattern (such as that shown in FIG. 26) and any shoelace (such as shoelace 94). The process results in shoelaces that follow a path that interweaves, resulting in reduced friction and faster and easier tightening and loosening. This process also results in a more controlled and tighter fitting system when the fastening knot inadvertently loosens.

To fasten around the user's foot, the upper may be provided with laces, Velcro, hook and loop fasteners, or any other convenient fastening devices. The upper may be mounted to the upper surface of the sole by any workable method, including sewing the upper to the sole with thread, bonding with glue or epoxy, directly injecting, fusing, welding, molding the two pieces together, or any combination thereof. Most materials typically used to manufacture dance shoe soles are ideally suited to the present application. Leather, for instance, offers excellent wear resistance, flexibility, has a relatively low coefficient of friction, and places less demands on the knowledge of current craftsmen. Plastics share these same characteristics and can be cast in almost any shape.

A process for lacing a shoe having a plurality of lace-holes in two parallel rows with a 2×2×1 lace-hole pattern and with a shoelace 94, in which the path followed by the shoelace that interweaves, comprises the following steps:

initial insertion of one lace-end through the top lace-hole 102 in one of the rows of lace-holes, entering the under surface of the lace-hole and emerging on the upper surface;

insertion of the other lace-end through the top lace-hole 103 in the other row of lace-holes, entering into the under surface of the lace-hole and emerging on the upper surface;

pulling the lace-ends until there is no substantial slack in the shoelace between the top pair of lace-holes 102, 103 and each side of the unlaced shoelace 94 is of approximately equal length;

sequentially, for each of the remaining pairs of lace-holes:

inserting the lace-end that emerges on the upper surface of a lace-hole 102, 103, 106, 107 into the top surface of the next lower lace-hole 104, 105, 108, 109, on the same side or inserting the lace-end that emerges on the lower surface of a lace-hole 104, 105, 108, 109 into the lower surface of the next lower lace-hole 106, 107, 110, 111 on the same side, when both lace-ends have been passed through the lowest pair of lace-holes 110, 111 desired to be laced, inserting the lace-end that emerges on the upper surface of a lace-hole 110, 111 in between the top surface of the shoe and the shoelace segment on the opposite side that is the nearest to the bottom lace-hole 110, 111, and this process is repeated until shoelaces have been inserted and pulled in a crisscross pattern through all of the top shoelace segments;

pulling first on the two lace segments protruding from the lowest lace-holes 110, 111 and then both lace-ends until there is no substantial slack in the shoelace and then tying both ends of the lace using a standard bow knot, other knots, or any other means, just as with the common lacing processes.

FIG. 26 represents an embodiment of the process of the present invention with pairs of lace-holes. The lace-hole pattern comprises any number of lace-holes where a shorter space between lace-holes precedes a longer space between lace-holes and then repeats this pattern for any given number of lace-holes until a single lace-hole remains at the bottom of the lacing area. While this lacing process will work with any shoe and with the standard lace-hole configuration, the 2×2×1 lace-hole pattern increases this lacing process's efficiency.

To eliminate uncomfortable tight-spots inherent in the common lacing processes, the lacing perimeter can be reinforced using thin plastic supports 96, 98 as shown in FIGS. 27 and 28. These reinforcing strips 96, 98 can be made of any standard rigid material, such as plastic or metal.

The shoelaces used in the process of the present invention can be of the same length and type used with the common lacing processes, and the tightened shoelaces can be secured by the standard bow knot, other knots, or any other means, just as with the common lacing processes. Just as a shoelace made of material with a lower coefficient of friction can be tightened more easily with the common lacing processes than a shoelace with higher friction, different kinds of shoelaces also handle differently in the same shoe when laced with the process of the present invention. However, shoes laced by the process of the present invention will invariably be easier to tighten and loosen than with the same shoelace laced by other processes.

Figure 29:
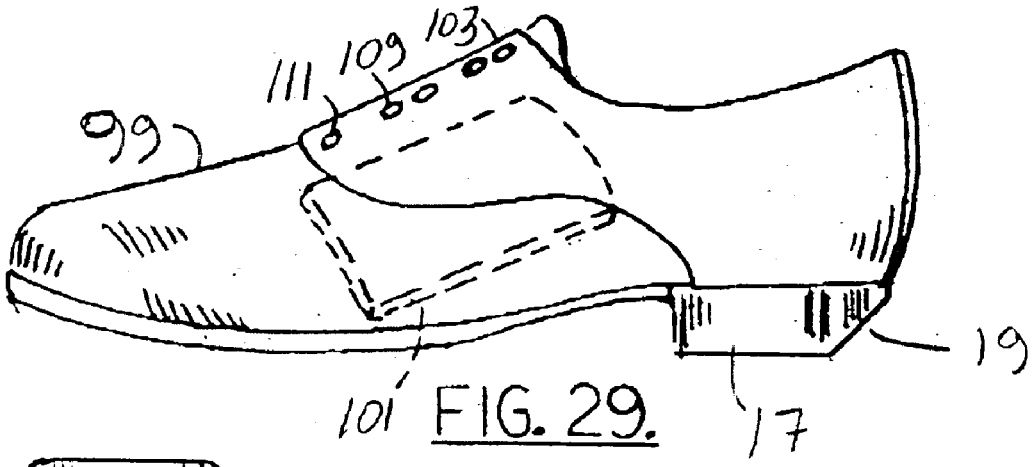
FIG. 29 is a side view of a shoe which has the special lace holes of FIG. 26 and three inserts.
Figure 30:
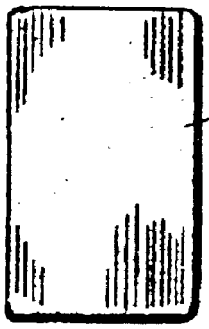
FIG. 30 is a plan view of an insert in the shoe shown in FIG. 29.
Figure 31:
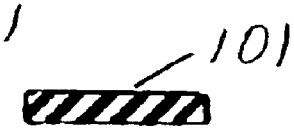
FIG. 31 is a sectional view of the insert of FIG. 30.
Figure 33:
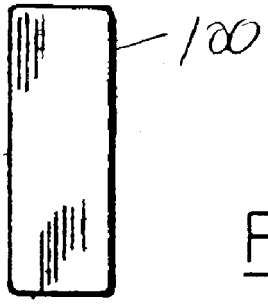
FIG. 33 is a plan view of an insert in the shoe shown in FIGS. 29 and 32.
Figure 34:
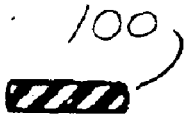
FIG. 34 is a sectional view of the insert of FIG. 33.
Figure 32:
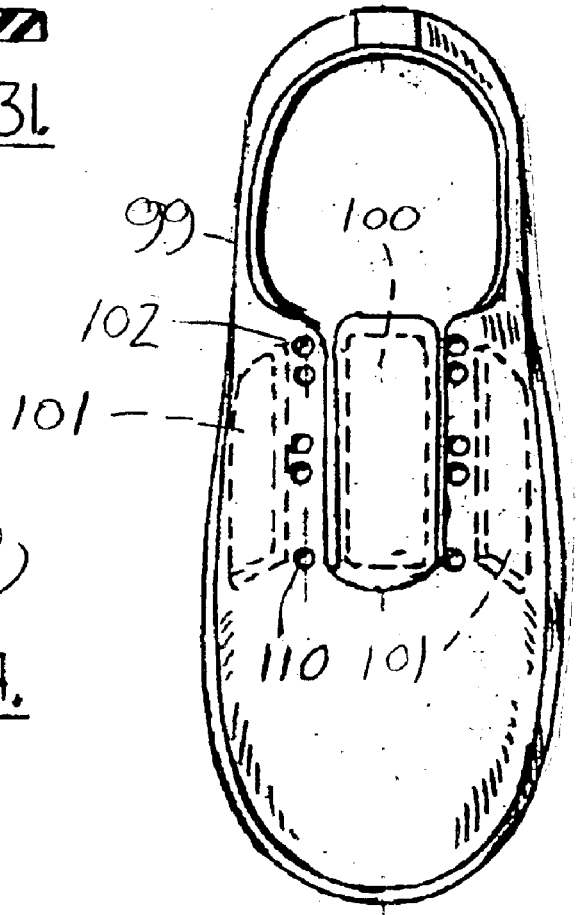
FIG. 32 is a plan view of the shoe shown in FIG. 29.

FIG. 29 is a side view of a shoe 99 which has the specially spaced lace holes shown in FIG. 26 and three inserts 100, 101, two as shown in FIGS. 30 (plan view) and 31 (sectional view) and one as shown in FIGS. 33 and 34 (in the tongue of shoe 99, as seen in FIG. 32). Inserts 100 and 101 could be made of foam rubber, for example.

Shoe 99 is shown in plan view in FIG. 32. Shoe 99 is similar to the first shoe 11 of dancer 83, but also incorporates abrasion and shock absorbing devices 100, 101 in the left side, right side and tongue portions of the shoe upper to protect the top of the feet of dancer 83 from the pressure exerted by the weight of dancer 84. These protecting devices 100, 101 can comprise any shock absorbing material such as Sorbothane® and can extend as far forward as the toe region.

The shape and size of the left and right side devices 101 will change according to shoe size, but on average the size is expected to be about 2"×1.5"×0.10" (about 5 cm×3.8 cm×0.25 cm) with a durometer hardness of 60 shore OO. The shape and size of the tongue device will change according to shoe size, but on average the size is expected to be about 2"×1"×0.10" (about 5 cm×2.5 cm×0.25 cm) with a durometer of 60 shore OO. The shock absorbing material can be affixed to the external portion of the shoe as a temporary addition or be built into the shoe's structure. It is usually covered by a layer of leather or felt, but is not required to be so covered. These protection devices 100, 101 can also be incorporated, either temporarily or permanently, into dancer's clothes such as socks or pant legs.

While a particular embodiment of the invention has been illustrated and described, various modifications can be made without departing from the spirit and scope of the invention, and all such modifications and equivalents are intended to be covered.

Though herein the method of using the shoes of the present invention is generally described with a second dancer standing on the foot of a first dancer, also the second dancer could be carried by the first dancer or could lean against the first dancer, without contacting the shoe of the first dancer.

Though herein typically a first dancer has shoes with an angled surface on the back of the heel (see FIG. 1), and a second dancer has shoes with an angled surface on the front of the heel (see FIG. 21), one could make a shoe combining the features of both shoes, such as for example by adding the angled surface of FIG. 1 to the heel of FIG. 21 (thus providing angle surfaces on the front and back of the heels, which shoes could be used in tap dancing, for example), to enable a dancer to be the first dancer or the second dancer, as described herein.

All measurements disclosed herein are at standard temperature and pressure, at sea level on Earth, unless indicated otherwise. All materials used or intended to be used in a human being are biocompatible, unless indicated otherwise.

Parts List

The following is a list of suitable parts and materials for the various elements of the preferred embodiment of the present invention.

| PARTS NO. | DESCRIPTION |
|---|---|
| 10 | lift spin dancing apparatus |
| 11 | first shoe |
| 12 | second shoe |
| 13 | second shoe alternate |
| 14 | upper |
| 15 | laces |
| 16 | sole |
| 17 | heel |
| 18 | heel bottom surface |
| 19 | inclined surface |
| 20 | angle |
| 21 | reference line |
| 22 | floor |
| 23 | reference line |
| 24 | rear seam |
| 25 | heel |
| 26 | heel bottom surface |
| 27 | inclined surface |
| 28 | heel |
| 29 | heel bottom surface |
| 30 | inclined surface |
| 31 | disk projecting portion |
| 32 | shaped body |
| 33 | central opening |
| 34 | fastener |
| 35 | spherical projecting portion |
| 36 | hemispherical opening |
| 37 | cylindrical socket |
| 38 | rotary bearing |
| 39 | central opening |
| 40 | inner ring |
| 41 | outer ring |
| 42 | hull bearing |
| 43 | projecting portion |
| 44 | shaft |
| 45 | disk |
| 46 | heel |
| 47 | forward hell section |
| 48 | rear heel section |
| 49 | bottom surface |
| 50 | inclined surface |
| 51 | socket |
| 52 | peg |
| 53 | slot |
| 54 | rail |
| 55 | heel |

-continued

| PARTS NO. | DESCRIPTION |
|---|---|
| 56 | heel bottom surface |
| 57 | insert |
| 58 | inclined surface |
| 59 | peg |
| 60 | socket |
| 61 | curved surface |
| 62 | curved surface |
| 63 | heel |
| 64 | compressible material |
| 65 | heel |
| 66 | upper |
| 67 | laces |
| 68 | sole |
| 69 | heel |
| 70 | heel bottom surface |
| 71 | inclined surface |
| 72 | cushion |
| 73 | concavity |
| 74 | upper |
| 75 | sole |
| 76 | high heel |
| 77 | heel bottom surface |
| 78 | inclined surface |
| 79 | cushion |
| 80 | removable lower |
| 81 | fastener |
| 82 | concavity |
| 83 | first dancer |
| 84 | second dancer |
| 85 | arrow |
| 86 | arrow |
| 87 | floor |
| 88 | forefoot |
| 89 | forefoot |
| 91 | insert |
| 92 | insert |
| 94 | shoe string |
| 95 | knot of shoe string 94 |
| 96 | reinforcing insert (made of plastic, metal, etc.) |
| 97 | opening in insert 96 |
| 98 | reinforcing insert (made of plastic, metal, etc.) |
| 99 | shoe |
| 100 | insert |
| 101 | insert |
| 102 | shoe lace hole |
| 103 | shoe lace hole |
| 104 | shoe lace hole |
| 105 | shoe lace hole |
| 106 | shoe lace hole |
| 107 | shoe lace hole |
| 108 | shoe lace hole |
| 109 | shoe lace hole |
| 110 | shoe lace hole |
| 111 | shoe lace hole |

The foregoing embodiments are presented by way of example only; the scope of the invention is to be limited only by the following claims.

What is claimed is:

1. A dancing shoe, comprising;

a) a shoe upper configured to fit the foot of a dancer, said upper having a longitudinal slot with holes on opposing sides of said slot;

b) a shoe lower that includes a sole and a heel;

c) the heel having a heel bottom surface and a rear beveled portion that has an inclined spinning surface that forms an angle of between 30 and 60 degrees with the heel bottom;

d) the plurality of holes being receptive of one or more shoe laces, said holes including first and second pairs of holes that are closely spaced and a third pair of holes that are not closely spaced to said first and second closely spaced pairs of holes, each said pair of holes having a hole that is aligned generally with a hole of another pair along one side of said opening;

e) lacing that is laced through the holes, said lacing beginning at an uppermost pair of holes, then extending along a longitudinal line that tracks one of each of said pair of holes, said laces being laced through a lower most hole, and lacing that extends diagonally from one hole to another hole along a vertical path.

2. The dancing shoe of claim 1 further comprising a reinforcing member that extends continuously along the shoe upper next to but spaced from the holes.

3. The dancing shoe of claim 1 wherein the reinforcing member extends along opposing sides of a row of said openings.

4. The dancing shoe of claim 1 wherein the pairs of holes include a total number of at least ten holes.

5. The dancing shoe of claim 4 wherein said holes include said first and second pairs of holes that are closely spaced, fourth and fifth pairs of holes that are closely spaced and positioned generally in between the third pair of holes, and the first and second pairs of holes.

6. The dancing shoe of claim 1 wherein the holes of the first and second pairs of holes are spaced apart along the slot a first longitudinal distance and the third pair of holes are spaced from the first and second pairs of holes a second longitudinal distance that is greater than said first longitudinal distance.

7. The dancing shoe of claim 1 wherein the holes of the first and second pairs of holes are spaced apart along the slot a first longitudinal distance, the third pair of holes being spaced from the first and second pairs of holes a second that is greater than said first longitudinal distance, and the fourth and fifth pairs of holes being spaced a third longitudinal distance along the slot from both the third pair of openings and the first and second pairs of openings a distance that is greater than the first longitudinal distance.

8. The dancing shoe of claim 7 further comprising hole reinforcing members that extend continuously along the slot next to but spaced from the holes.

9. The dancing shoe of claim 1 further comprising a projecting portion that is mounted to the heel on the spinning surface and that projects away from the spinning surface.

10. The dancing shoe of claim 9 wherein the projecting portion is rotatably attached to the heel.

11. The dancing shoe of claim 9 further comprising a layer of compressible material attached to the heel at the spinning surface next to the projecting portion.

12. The dancing shoe of claim 11 wherein the projecting portion and layer of compressible material are of about the same thickness.

13. The dancing shoe of claim 11 wherein the layer of compressible material surrounds the projecting portion.

14. The dancing shoe of claim 1 wherein the heel includes two connectable sections, one section having the beveled portion.

15. The dancing shoe of claim 1 further comprising a second projecting portion mounted on the sole of the shoe in front of the heel.

16. The dancing shoe of claim 1 wherein there are a plurality of projecting portions attached to the heel at the spinning surface.

17. The dancing shoe of claim 13 wherein the plurality of projecting portions are attached to the heel at spaced apart positions.

18. The dancing shoe of claim 15 further comprising a layer of compressible material attached to the sole in front of the heel and next to the second projecting portion.

* * * * *